US006453146B1

(12) United States Patent
Yamada et al.

(10) Patent No.: US 6,453,146 B1
(45) Date of Patent: Sep. 17, 2002

(54) CLEANING BLADE FOR LATENT IMAGE HOLDING MEMBER, APPARATUS FOR FORMING IMAGE AND PROCESS FOR FORMING IMAGE

(75) Inventors: Taichi Yamada; Satoshi Shigezaki; Yoshinari Ueno; Masahiro Takagi; Satoshi Inoue, all of Minamiashigara; Makoto Sakanobe, Ebina; Tomoki Kutsuwada, Ebina; Yoshinori Nakano, Ebina, all of (JP)

(73) Assignee: Fuji Xerox Co., LTD, Tokyo (JP)

( * ) Notice: Subject to any disclaimer, the term of this patent is extended or adjusted under 35 U.S.C. 154(b) by 0 days.

(21) Appl. No.: 09/880,878

(22) Filed: Jun. 15, 2001

(30) Foreign Application Priority Data

Aug. 25, 2000 (JP) ..... 2000-256052

(51) Int. Cl.[7] ..... G03G 21/00
(52) U.S. Cl. ..... 399/350
(58) Field of Search ..... 15/256.5, 256.51, 15/256.52; 399/343, 345, 350, 351; 430/110

(56) References Cited

U.S. PATENT DOCUMENTS 5,732,320 A * 3/1998 Domagall et al. ..... 399/350
5,765,088 A * 6/1998 Nakayama et al. ..... 399/350
5,948,582 A * 9/1999 Nakamura et al. ..... 430/110

FOREIGN PATENT DOCUMENTS

| | | |
|---|---|---|
| JP | 60-131547 A | 7/1985 |
| JP | 5-188643 A | 7/1993 |
| JP | 6-148941 A | 5/1994 |
| JP | 8-254873 A | 10/1996 |

* cited by examiner

*Primary Examiner*—Arthur T. Grimley
*Assistant Examiner*—Hoang Ngo
(74) *Attorney, Agent, or Firm*—Oliff & Berridge, PLC

(57) ABSTRACT

A cleaning blade for a latent image holding member, an apparatus for forming an image and a process for forming an image are provided at a low cost, in which even in an apparatus for forming an image using a spherical toner, good cleaning property of the latent image holding member is ensured irrespective to the temperature environment upon use without deteriorating an image quality. The cleaning blade for removing a remaining toner by making in contact with a latent image holding member under pressure, as well as an apparatus for forming an image and a process for forming an image using the same are provided. The cleaning blade contains an elastic material having a 300% modulus of about from 14,700 to 29,400 kPa and a tearing strength of about 68,600 N/m or more.

19 Claims, 1 Drawing Sheet

CLEANING BLADE FOR LATENT IMAGE HOLDING MEMBER, APPARATUS FOR FORMING IMAGE AND PROCESS FOR FORMING IMAGE

FIELD OF THE INVENTION

The present invention relates to a cleaning blade for a latent image holding member used in an apparatus for forming an image using an electrophotographic process, such as a duplicator, a facsimile machine and a printer, and also relates to an apparatus for forming an image and a process for forming an image using the cleaning blade for a latent image holding member.

BACKGROUND OF THE INVENTION

In an electrophotographic process, conventionally, the surface of a latent image holding member is charged and exposed to form an electrostatic latent image, which is then developed with a colored toner to form a toner image as a visible image, and the toner image is transferred to a transfer material, such as transfer paper, and fixed, for example, by a heat roll to form an image. Since a non-transfer toner generally remains on the surface of the latent image holding member after completing the transfer of the toner image, it is necessary that it is removed by a certain cleaning unit before conducting the next image formation step. Other foreign substances attached to the surface of the latent image holding member are generally removed along with the remaining toner by the cleaning unit.

As the cleaning unit for removing the remaining toner after transfer, various methods including a method using a fur brush or a magnetic brush and a method using a rubber blade are employed, and such a method is generally employed that the toner is scraped off by rubbing the latent image holding member with a cleaning blade formed with an elastic material because of the low cost and the high stability in performance. As the elastic material used as the material of the cleaning blade, polyurethane rubber is often used owing to the excellent wear resistance thereof.

In recent years, high image quality is demanded in the apparatus for forming an image of this kind, and the toner is demanded to have a smaller diameter and a spherical shape along with the demand for high image quality. The reproducibility of dots of a toner image formed on the latent image holding member can be improved by decreasing the toner diameter, and the developing property and the transferring property can be improved by using the toner of a spherical shape.

With respect to the production process of a toner, when the diameter of a toner is to be decreased by a pulverization method, which is one of the production processes of a toner that have been conventionally used, the yield upon production of the toner is deteriorated, and as a result, the cost of the toner is increased. Under the circumstances, in recent years, the polymerization method, in place of the conventional pulverization method, attracts attention as a production process of a toner having a small diameter and a spherical shape because it is advantageous in cost even when the toner having a small diameter and a spherical shape is produced. The polymerization method includes a suspension polymerization method, an emulsion polymerization method and a dispersion polymerization method.

However, in the case where the toner having a small diameter and a spherical shape (hereinafter, sometimes referred to as a "spherical toner") is used, there are some cases where good cleaning performance cannot be obtained by the blade cleaning method particularly using a rubber blade. In particular, the cleaning property is remarkably deteriorated in the case of a toner of a substantially spherical shape having a shape factor SF of the toner of 125 or less. Even in the case of a toner having a shape factor SF of from 125 to 135, a toner having a substantially spherical shape is contained when the toner has a shape distribution, and there is a tendency that the cleaning property is deteriorated with the lapse of time.

The cleaning property tends to be deteriorated when the toner used for development has a smaller diameter and a sharper particle size distribution. Particularly, the deterioration of the cleaning property becomes conspicuous under a low temperature and low humidity environment. Although the cleaning property under a low temperature and low humidity environment can be improved by increasing the contact pressure of the cleaning blade to the latent image holding member, when they are used under a high temperature and high humidity environment with the high contact pressure maintained, the adhesion strength of the latent image holding member and the cleaning blade is increased to increase the deformation amount of the tip of the blade, whereby breakage of the blade edge or curling of the cleaning blade sometimes occurs. In order to obtain good cleaning pry under any environment with long term use when the spherical toner is used, it is necessary that the rubber property and the set conditions of application of the cleaning blade are strictly adjusted, and it is extremely difficult to retain the balance thereof.

Because a latent image holding member is rubbed with a rubber blade to scrape off a toner in the cleaning method using a rubber blade, the tip of the edge of the rubber blade is deformed by the friction resistance to form minute cuneate spaces between them. The toner having a smaller diameter is liable to invade into the spaces to the tip of the edge, and the toner invading to the tip of the edge is difficult to be replaced to form a remaining region. No cleaning failure occurs under the conditions where the friction coefficient between the toner in the remaining region and the latent image holding member is relatively small, and the toner slides on the latent image holding member. However, when the friction coefficient between the toner and the latent image holding member is increased by drop off of an external additive due to friction with the latent image holding member, the rolling resistance of the spherical toner is smaller than the conventional pulverized toner of an irregular shape, and it is considered that the spherical toner starts to roll between the cleaning blade and the latent image holding member to go through them.

In the case of a spherical toner having a further sharp particle size distribution, because it is liable to suffer the closest packing in comparison to the toner of an irregular shape, it is considered that consolidation is liable to occur in the minute spaces in the vicinity of the contact point between the edge of the cleaning blade and the latent image holding member to increase the friction force between the latent image holding member and the toner, whereby the toner is liable to roll. Because the charged amount of the toner becomes high under a low temperature and low humidity environment, the adhesion force between the latent image holding member and the toner is increased to accelerate the rolling of the toner.

In order to prevent the cleaning failure of the cleaning blade in an apparatus for forming an image using the spherical toner, a process for forming an image using a mixture of a spherical toner and a toner of an irregular shape is proposed in JP-A 131547 and JP-A6-148941. In these processes, however, since a mixture of a spherical toner and a toner of an irregular shape is used as a toner for development, a problem occurs in that a precise and uniform image and a high transfer efficiency, which is an advantage of the spherical toner, cannot be obtained in comparison to the case using only the spherical toner.

JP-A-8-254873 proposes that in an apparatus for forming an image constituted by plural developing units for developing images of different colors, a toner of an irregular shape is installed in at least one of the developing units, and a spherical toner is installed in the other developing units. The process also has a problem in that a precise and uniform image and a high transfer efficiency, which is an advantage of the spherical toner, cannot be obtained in comparison to the case where development is conducted by using only developing units having the spherical toner installed. Furthermore, the advantages cannot be obtained in an apparatus for forming a full color image by a tandem type.

A method of supplying a lubricating agent to a latent image holding member to prevent clog failure of a cleaning blade in an apparatus for forming an image using the spherical toner (for example, JP-A-5-188643) is propose. However, cleaning failure occurs when the supply of a lubricating agent to the latent image holding member becomes shore and adverse influence due to filming on the latent image holding member occurs when the supply is excessive. Therefore, it is necessary that the lubricating agent is uniformly supplied to the latent image holding member for a long period of time, and thus the designing of the apparatus involves terrific difficulty. Furthermore, since the apparatus is recently downsized, it is very difficult to assure a space for arranging a unit for supplying a lubricating agent that supplies a lubricating agent directly to the surface of the latent image holding member particularly in an apparatus for forming an image using a latent image holding member of a small diameter. In particular, it is necessary to provide the unit for supplying a lubricating agent on each of the latent image holding members in an apparatus for forming an image of the tandem type, and it is considerably disadvantageous in cost reduction.

The invention has been made in view of the foregoing circumstances and provides, at a low cost, a cleaning blade for a latent image holding member that ensures good cleaning property of the latent image holding member irrespective to a temperature environment upon using without deterioration in image quality even in an apparatus for forming an image using a spherical toner, as well as an apparatus for forming an image and a process for forming an image.

The inventors have conducted earnest investigations to attain the aims of the invention, and as a result, it has been found that the aims can be attained by using a cleaning blade having particular properties to accomplish the invention.

According to an aspect of the invention, the cleaning blade removes a remaining toner by contact with a latent image holding member under pressure, the cleaning blade containing an elastic material having a 300% modulus of about from 14,700 to 29,400 kPa (about from 150 to 300 kg/cm$^2$) and a tearing strength of about 68,600 N/m or more (about 70 kgf/cm or more).

According to another aspect of the invention, the apparatus for forming an image contains a latent image holding member, a latent image forming unit for forming a latent image on a surface of the latent image holding member, a developing unit for developing the latent image formed on the surface of the latent image holding member with a toner to form a toner image; a transferring unit for transferring the toner image formed on the surface of the latent image holding member to a transfer material; and a cleaning unit for removing a remaining toner on the surface of the latent image holding member after the transfer. The cleaning unit has a cleaning blade rubbing the surface of the latent image holding member therewith, and the cleaning blade has an elastic material having a 300% modulus of about from 14,700 to 29,400 kPa (about from 150 to 300 kgf/cm$^2$) and a tearing strength of about 68,600 N/m or more (about 70 kgf/cm or more).

According to a further aspect of the invention, the process for forming an image contains a latent image forming step of forming a latent image on a surface of a latent image holding member, a developing step of developing the latent image formed on the surface of the latent image holding member with a toner to form a toner image; a transferring step of transferring the toner image formed on the surface of the latent image holding member to a transfer material; and a cleaning step of removing a remaining toner on the surface of the latent image holding member after transfer. The cleaning step contains a step of rubbing the surface of the latent image holding member with a cleaning blade, and the cleaning blade contains an elastic material having a 300% modulus of about from 14,700 to 29,400 kPa (about from 150 to 300 kgf/cm$^2$) and a tearing strength of about 68,600 N/m or more (about 70 kgf/cm or more).

As described in the foregoing, the reason why the cleaning property of the spherical toner is poor as compared to the toner of an irregular shape is ascribed to the face that the spherical toner having a low rolling friction coefficient rolls between the cleaning blade and the latent image holding member, and in order to improve the cleaning property of the spherical toner, it is important how to stably suppress the rolling of the spherical toner for a long period of time irrespective to the environment of use.

The inventors have found that the use of a cleaning blade containing an elastic material satisfying a 300% modulus of about from 14,700 to 29,400 kPa (about from 150 to 300 kgf/cm$^2$) and a tearing strength of about 68,600 N/m or more (about 70 kgf/cm or more) is effective to stably suppress the rolling of the spherical toner at a minute deformed part at the tip of the cleaning blade for a long period of time, so as to accomplish the invention.

BRIEF DESCRIPTION OF THE DRAWINGS

Preferred embodiments of the invention will be described in detail based on the following figures, wherein.

DETAILED DESCRIPTION OF THE PREFERRED EMBODIMENTS

Figure 1:
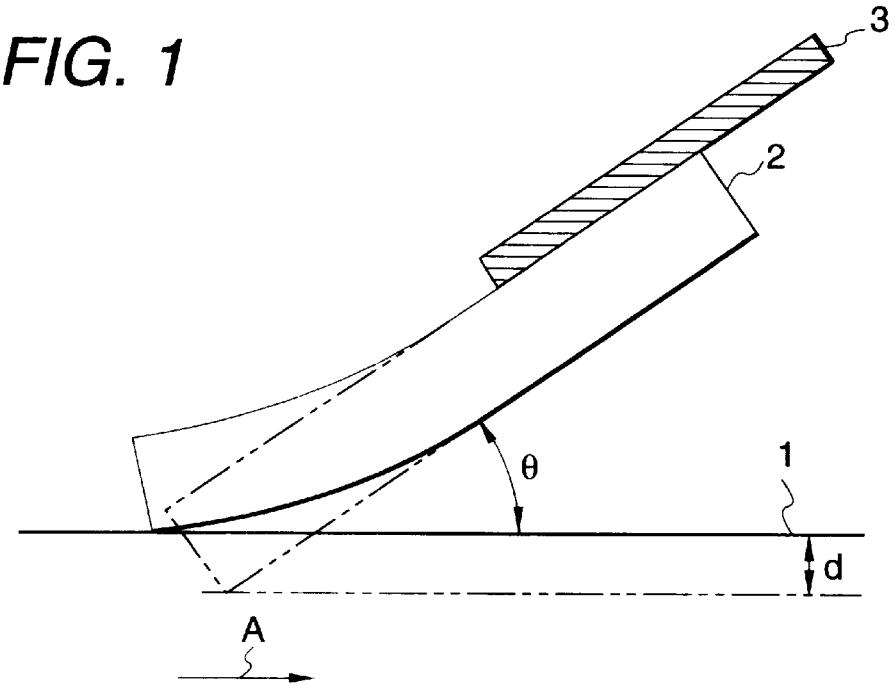
FIG. 1 is a schematic enlarged cross sectional view showing the state of a cleaning blade of the invention that is pressed on the surface of a latent image holding member.

The invention will be described in more detail below.

Cleaning Blade for Electrophotography

The cleaning blade for a latent image holding member of the invention will be described in detail below.

The cleaning blade for a latent image holding member of the invention hereinafter, sometimes simply referred to as a "cleaning blade") is a cleaning blade for removing a remaining toner by contacting with the latent image holding member under pressure, and the cleaning blade is formed with an elastic material having a 300% modulus of about from 14,700 to 29,400 kPa (about from 150 to 300 kgf/cm) and a tearing strength of about 68,600 N/m or more (about 70 kgf/cm or more).

The measurement of the 300% modulus, which is the property defining the cleaning blade of the invention, is conducted according to the test method for vulcanized rubber, JIS K6301 (1988), and the detailed conditions are as follows. A rubber test sample having the shape described in JIS K6301 (1988) is allowed to stand under an environment of 23° C. for 1 hour or more, and is subjected to a tensile test at a constant speed with the prescribed jig. The load at the time when the elongation amount becomes 300% of the original length is divided by the cross sectional area of the rubber specimen to obtain the measured value.

The cleaning blade of the invention necessarily has a 300% modulus of about from 14,700 to 29,400 kPa (about from 150 to 300 kgf/cm$^2$), preferably from 15,680 to 22,540 kPa (about from 160 to 230 kgf/cm$^2$), and more preferably from 16,660 to 19,600 kPa (about from 170 to 200 kgf/cm$^2$). When the 300% modulus is too low, stress concentration occurs at the tip of the edge of the cleaning blade, which rubs the latent image holding member and is deformed, to cause breakage of the edge, whereby the durability is deteriorated. When the 300% modulus is too high, on the other hand, the following property of the cleaning blade to the surface shape of the latent image holding member causes cleaning failure due to contact failure.

The 100% modulus of the cleaning blade of the invention is preferably about from 4,900 to 6,860 kPa (about from 50 to 70 kgf/cm3, and more preferably about from 5,390 to 6,370 kPa (about from 55 to 65 kgf/cm$^2$). When the 100% modulus is too low, the stiffness of the cleaning blade becomes low to decease the contact pressure, and the contact area with the latent image holding member is increased to bring about increase in friction force and reduction in lubricating property, whereby the durability is disadvantageously decreased. When the 100% modulus is too high, on the other hand, it is not preferred since flaws are liable to be formed on the surface of the latent image holding member. The measurement of the 100% modulus is conducted according to the test method for vulcanized rubber, JIS K6301, and the detailed conditions are as follows. A rubber test sample having the shape described in JIS K6301 (1988) is allowed to stand under an environment of 23° C. for 1 hour or more, and is subjected to a tensile test at a constant speed with the prescribed jig. The load at the time when the elongation amount becomes 100% of the original length is divided by the cross sectional area of the rubber specimen to obtain the measured value.

The cleaning blade of the invention necessarily has a tearing strength of about 68,600 N/m or more (about 70 kgf/cm or more), preferably 73,500 N/m or more (about 75 kgf/cm or more), and more preferably 78,400 N/m or more (about 80 kgf/cm or more). When the tearing strength is too small, it is not preferred since breakage of the edge is liable to occur to deteriorate the durability. When the tearing strength is about 68,600 N/m or more (about 70 kgf/cm or more), breakage of the cleaning blade can be prevented even under a high temperature and high humidity environment. The measurement of the tearing strength is conducted according to the test method of tearing strength for vulcanized rubber, JIS K6252 (2000), and the detailed conditions are as follows. A rubber test sample for the test method of tearing strength having the shape described in JIS K6252 (2000) is allowed to stand under an environment of 23° C. for 1 hour or more, and is subjected to a tensile test at a constant speed with the prescribed jig, and the maximum load until the test sample is torn is measured. The tearing strength Tr is calculated by the following equation.

$$Tr=F/t$$

wherein Tr represents the tearing strength (N/m), F represents the maximum load (N), and t represents the thickness of the tested part of the test sample (m).

The cleaning blade of the invention preferably has a hardness (JIS A Scale) of about from 73 to 85, and more preferably from 77 to 80. When the hardness is too low, the stiffness of the cleaning blade becomes small to decrease the contact pressure, and the contact area with the latent image holding member is increased to bring about increase in friction force and reduction in lubricating property, whereby the durability is disadvantageously decreased. When the hardness is too high, on the other hand, it is not preferred since flaws are liable to be formed on the surface of the latent image holding member.

The cleaning blade of the invention preferably has a tensile strength of about 37,240 kPa or more (380 kg/cm$^2$ or more), and more preferably 39,200 kPa or more (400 kgf/cm$^2$ or more). When the tensile strength is too small, it is not preferred since the durability of the cleaning blade becomes insufficient. The measurement of the tensile strength is conducted according to the test method for vulcanized rubber, JIS K6251 (2000), and the detailed conditions are as follows. A rubber test sample having the shape described in the test method for vulcanized rubber, JIS K6251 (2000), is allowed to stand under an environment of 23° C. for 1 hour or more, and is subjected to a tensile test at a constant speed with the prescribed jig. The maximum load until the test sample is broken is measured.

The cleaning blade of the invention is formed into such a shape that can be used as a cleaning blade for a latent image holding member in an ordinary electrophotographic apparatus. In the case of the so-called blade form which is in contact with the latent image holding member at the edge thereof, while the overall shape is not particularly limited, the thickness is generally selected from the range of from 1.5 to 2.5 mm, and preferably selected from the range of from 1.8 to 2.2 mm. The free length (the distance between the position, where the cleaning blade is fixed inside the apparatus, and the position of the edge, at which the cleaning blade is in contact with the latent image holding member) of the cleaning blade is generally selected from the range of from 5 to 15 mm, and preferably selected from the range of from 7 to 12 mm. The width of the cleaning blade can be appropriately set depending on the length in the axial direction of the latent image holding member (specifically, the length in the axial direction of the region, on which a latent image is to be formed, of the latent image holding member).

The material of the cleaning blade of the invention is not particularly limited as far as the foregoing characteristics are satisfied, and various elastic materials can be used. Specific examples of the elastic material include polyurethane, silicone rubber, nitrile rubber and chroloprene rubber.

As a polyurethane elastic material, polyurethane synthesized through an addition reaction of an isocyanate, a polyol and various kinds of hydrogen-containing compounds is used. It is produced by the following manner. A urethane prepolymer is prepared by using a polyol component and an isocyanate component. Examples of the polyol component include a polyether series polyol, such as polypropylene glycol and polytetramethylene glycol, and a polyester series polyol, such as an adipate series polyol, a polycaprolactam series polyol and a polycarbonate series polyol. Examples of the isocyanate component include an aromatic series polyisocyanate, such as tolylene diisocyanate, 4,4'-diphenylmethane dissocyanate, polymethylene polyphenyl polyisocyanate and toluidine diisocyanate, and an aliphatic series polyisocyanate, such as hexamethylene diisocyanate, isophorone diisocyanate, xylylene diisocyanate and dicyclohexylmethane diisocyanate. A hardening agent is added to the urethane prepolymer, and the mixture is injected into a mold and hardened by crosslinking, followed by aging at ordinary temperature, so as to produce a polyurethane elastic material. As the hardening agent, a two-valent alcohol, such as 1,4-butanediol, and a three-valent alcohol, such as trimethylolpropane and pentaerythritol, are used in combination.

The cleaning blade of the invention is effective in an apparatus for forming an image using a spherical toner that involves a problem in cleaning property. In particular, a toner having a shape of an average shape factor SF expressed by the following equation (1) of about from 100 to 135 (toner particles in the case where an external additive is contained) involves a problem in rolling at the minute deformed part of the tip of the cleaning blade, and the remaining toner in the case using that toner can be extremely effectively removed by using the cleaning blade of the invention.

$$SF=100\times\pi ML^2/4A \quad (1)$$

wherein ML represents a maximum length of a toner particle, and A represents a projected area of a toner particle.

The average shape factor SF herein means an arithmetic average of the values of the shape factor SF obtained for toner particles and can be obtained, for example, by the following manner. A toner is sampled and introduced in an image analyzer (Luzex III, produced by Nireco Corporation), and analysis is conducted for 100 toner particles to obtain diameters equivalent of circles for respective toner particles. The shape factors SF of the respective toner particles are obtained from the absolute maximum length and the projected area, and an arithmetic average thereof is obtained. The shape factor SF satisfies SF=100 in the case of true sphere.

In the case where the spherical toner is used, it is preferred to add spherical inorganic fine particles having an average particle diameter of from 50 to 500 nm as an external additive.

Apparatus and Process for Forming Image

The apparatus for forming an image and a process for forming an image according to the invention will be described in detail below.

The apparatus for forming an image according to the invention contains a latent image holding member, a latent image forming unit for forming a latent image on a surface of the latent image holding member, a developing unit for developing the latent image formed on the surface of the latent image holding member with a toner to form a toner image; a transferring unit for transferring the toner image formed on the surface of the latent image holding member to a transfer material; and a cleaning unit for removing a remaining toner on the surface of the latent image holding member after the transfer, in which the cleaning unit contains a cleaning blade rubbing the surface of the latent image holding member, and the cleaning blade contains an elastic material having a 300% modulus of about from 14,700 to 29,400 kPa (about from 150 to 300 kgf/cm$^2$) and a tearing strength of about 68,600 N/m or more (about 70 kgf/cm or more).

That is, in an ordinary electrophotographic type apparatus for forming an image having a cleaning unit, the cleaning blade for electrophotographic according to the invention is used as the cleaning unit. The details of the cleaning blade for electrophotography of the invention as the cleaning unit are the same as those described in the foregoing, and the required or preferred embodiments with respect to the properties, the shapes and the materials are also the same as those described in the foregoing.

The contact pressure of pressing the cleaning blade to the latent image holding member is preferably about from $9.8\times10^{-3}$ to $4.9\times10^{-2}$ N/mm (about from 1.0 to 5.0 gf/mm), and it can be used under a high ping contact pressure of from $3.9\times10^{-2}$ to $4.9\times10^{-2}$ N/mm (from 4.0 to 5.0 gf/mm). When the pressing contact pressure thereof is less than $9.8\times10^{-3}$ n/mm (1.0 gf/mm), there are cases where cleaning unevenness occurs, and when it exceeds $4.9\times10^{-2}$ N/mm (5.0 gf/mm), there are cases where the surface of the latent image holding member is damaged, and the wear amount is increased, both cases of which are not preferred.

The cleaning blade is deformed as shown in FIG. 1 by pressing onto the surface of the latent image holding member. In FIG. 1, numeral 2 denotes the cleaning blade, and 1 denotes the latent image holding member rotating in the direction shown by the arrow A. The cleaning blade is pressed onto the surface of the latent image holding member 1 by a retaining member 3.

The breaking amount of the cleaning blade (the deformation amount of the cleaning blade by pressing onto the surface of the latent image holding member (shown by d in FIG. 1)) is preferably about from 0.8 to 1.6 mm, and more preferably about from 1.0 to 1.4 mm, while it cannot be determined unconditionally. The contact angle of the cleaning blade to the latent image holding member (the angle formed by the tangent line of the surface of the latent image holding member and the cleaning blade (shown by θ in FIG. 1)) is preferably about from 18 to 28° while it cannot be determined unconditionally.

Figure 2:
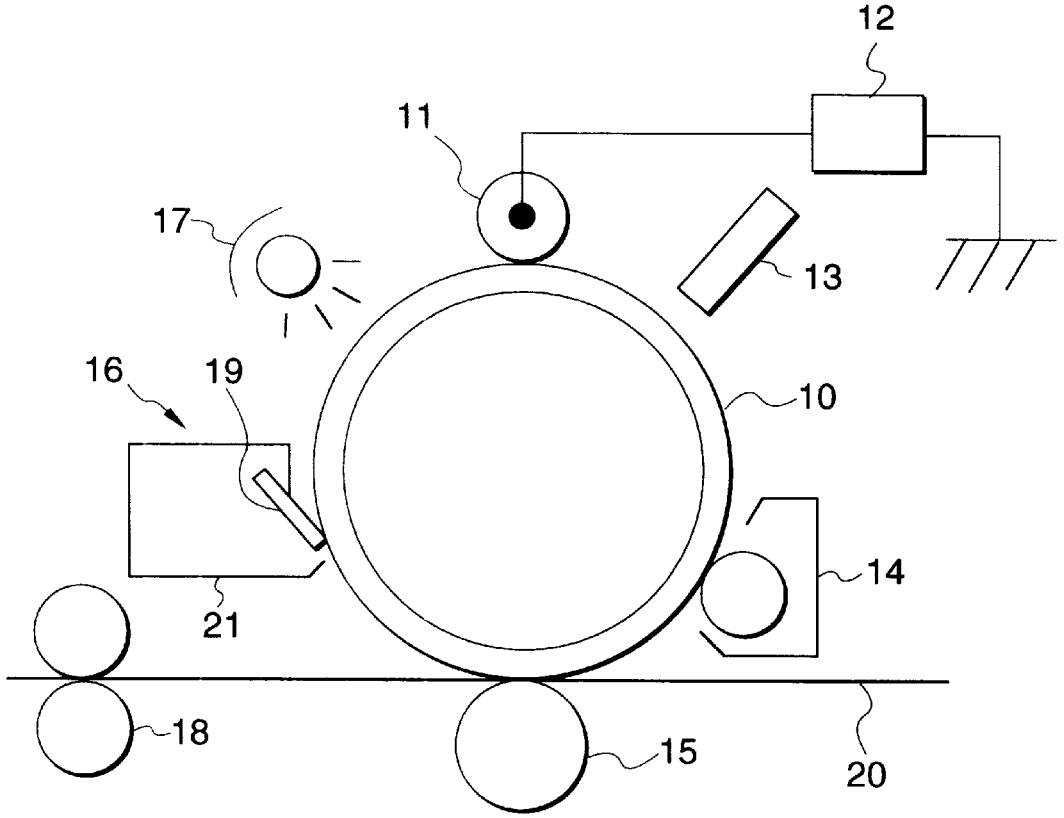
FIG. 2 is a schematic cross sectional view showing an electrophotographic apparatus as an example of the apparatus for forming an image according to the invention.

The apparatus for forming an image according to the invention will be described in more detail with reference to the drawing. FIG. 2 is a schematic cross sectional view showing an electrophotographic apparatus as one embodiment of the apparatus for forming an image according to the invention. The electrophotographic apparatus shown in FIG. 2 has an electrophotographic photoreceptor (latent image holding member) 10, a charging device (charging unit) 11 for charging the surface of the electrophotographic photoreceptor 10, a power source 12 for applying a voltage on the charging unit 11, an image input device (latent image forming unit) 13 for forming a latent image on the surface of the electrophotographic photoreceptor 10, a developing device (developing unit) 14 for developing the latent image formed on the surface of the electrophotographic photoreceptor 10 with a toner to obtain a toner image, a transferring device (transferring unit) 15 for transferring the toner image thus formed to the surface of a transfer material 20, a cleaning device (cleaning unit) 16 for removing a remaining toner on the surface of the electrophotographic photoreceptor 10 by a blade 19 that is the cleaning blade of the invention, a destaticizing device 17 for removing a remaining potential on the surface of the electrophotographic photoreceptor 10, and a fixing device 18 for fixing the toner image transferred to the surface of the transfer material 20 by heat and/or pressure.

In FIG. 2, the charging device 11 of a contact charging type, such as a charging roller, is arranged on the electrophotographic photoreceptor 10, and the charging device 11 is driven by a voltage supplied from the power source 12. While the charging device 11 of the contact charging type is used in this embodiment, both the contact charging type and the non contact charging type can be used in the invention.

The cleaning device 16 is constituted with a box 21 and a blade 19 arranged at an opening of the box, and the blade 19 is the cleaning blade according to the invention. The cleaning device has such a structure that the remaining toner removed from the surface of the electrophotographic photoreceptor 10 is contained in the box 21.

The constitutions of the image input device (latent time forming unit) 13, the developing device (developing unit) 14, the transfer device (transfer unit) 15, the destaticizing device 17 and the fixing device 18 are not particularly limited in the invention, and all the constitutions that have been known in the field of electrophotography can be applied as they are. In the case of the constitution where the charging device 11 of the contact charging type is used, the destaticizing device 17 is not necessarily provided.

The process for forming an image according to the invention will be described with reference to the electrophotographic apparatus shown in FIG. 2. The surface of the electrophotographic photoreceptor latent image holding member) 10 is uniformly charged with the charging device 11, and a latent image is formed thereon by the image input device (latent image forming unit) 13 (the latent image arming step). The latent image formed on the electrophotographic photoreceptor 10 is developed with a toner contained in the developing device (developing unit) 14 to form a toner image (the developing step). The toner image formed on the surface of the electrophotographic photoreceptor 10 is transferred to a transfer material 20 that is inserted between the electrophotographic photoreceptor 10 and the transferring device (transferring unit) 15 facing the same (the transferring step), and is fixed thereon by the fixing device 18 with heat and/or pressure. The remaining toner on the surface of the electrophotographic photoreceptor 10 after transfer is removed by the cleaning device (cleaning unit) 16 having the blade 19 (the cleaning step). The remaining potential on the surface of the electrophotographic photoreceptor 10 is removed by the destaticizing device 17 before the next image formation cycle proceeds.

(1) Toner

A toner that is preferably used in the apparatus for forming an image and the press for forming an image according to the invention will be described below.

The apparatus for forming an image and the process for forming an image according to the invention are effective in the case where a spherical toner, which involves a problem in cleaning property, is used as a toner. Particularly, in the toner having a shape of an average shape factor SF defined by the following equation (1) of from 100 to 135 (toner particles in the case where an external additive is contained), rolling at the minute deformed part at the tip of the cleaning blade is liable to bring about a problem, and the remaining toner can be extremely effectively removed by the apparatus for forming an image of the invention when that toner is used.

$$SF=100\times\pi ML^2/4A \quad (1)$$

wherein ML represents a maximum length of a toner particle, and A represents a projected area of a toner particle.

When a toner having an average shape factor SF of from 100 to 125 is used, further high developing property and transferring property can be obtained, and an image of high quality can be obtained.

The toner used in the invention is preferably formed with toner particles containing at least a binder resin and a colorant, and an external additive. The respective constitutional components of the toner that can be preferably used in the invention will be separately described in more detail.

Toner Particles

The toner particles contain at least a binder resin and a colorant, and a releasing agent and other components are contained depending on necessity.

Examples of the binder resin of the toner particles include a homopolymer and a copolymer of a styrene compound, such as styrene and chlorostyrene; a monoolefin compound, such as ethylene, propylene, butylene and isoprene; a vinyl ester compound, such as vinyl acete, vinyl propyonate, vinyl benzoate and vinyl butyrate; an α-methylene aliphatic monocaboxylic ester, such as methyl acrylate, ethyl acrylate, butyl acrylate, dodecyl acrylate, octyl acrylate, phenyl acrylate, methyl methacrylate, ethyl methacrylate, butyl methacrylate and dodecyl methacrylate; a vinyl ether compound, such as vinyl methyl ether, vinyl ethyl ether and vinyl butyl ether; and a vinyl ketone compound, such as vinyl methyl ketone, vinyl hexyl ketone and vinyl isopropenyl ketone. Representative examples of the binder resin include polystyrene, a styrene-alkyl acrylate copolymer, a styrene-alkyl methacrylate copolymer, a styrene-acrylonitrile copolymer, a styrene-butadiene copolymer, a styrene-maleic anhydride copolymer polyethylene and polypropylene. Further examples thereof include polyester, polyurethane, an epoxy resin, a silicone resin, polyamide, modified rosin and paraffin wax.

Representative examples of the colorant of the toner include magnetic powder, such as magnetite and-ferrite, Non black, Aniline Blue, Calco Oil Blue, Chrome Yellow, Ultramarine Blue, Du Pont Oil Red, Quinoline Yellow, Methylene Blue Chloride, Phthalocyanine Blue, Malachite Green Oxalate, lamp Black, Rose Bengal, C.I. Pigment Red 48:1, C.I. Pigment Red 122, C.I. Pigment Red 57:1, C.I. Pigment Yellow 97, C.I. Pigment Yellow 17, C.I. Pigment Yellow 74, C.I. Pigment Yellow 180, C.I. Pigment Blue 15:1 and C.I. Pigment Blue 15:3.

Representative examples of the releasing agent contained in the toner particles include low molecular weight polyethylene, low molecular weight polypropylene, Fischer-Tropsch wax, montan wax, carnuba wax, rice wax and candelilla wax.

A charge controlling agent may be added to the toner particles depending on necessity. Known charge controlling agents can be used, and an azo series metallic complex compound, a metallic complex compound of salicylic acid and a resin type charge controlling agent containing a polar group can be use. In the case where the toner particles are produced by a wet production process, it is preferred to use a material that is difficult to be dissolved in water from the standpoint of control of ionic strength and reduction of waste water pollution.

The toner particles used in the invention may be either a magnetic toner containing a magnetic material or a non-magnetic toner containing no magnetic material.

The volume average particle diameter of the toner particles that can be used in the invention is preferably in the range of from 2 to 9 μm, and more preferably in the range of from 3 to 7 μm.

The production process of the toner particles that can be preferably used in the invention is not particle limited as far as the resulting toner particles satisfy the shape factor and the particle diameter described in the foregoing, and known production processes can be applied. Examples of the production process of the toner particles include a kneading and pulverization process, in which a binder resin and a colorant with, depending on necessity, a releasing agent and a charge controlling agent are subjected to kneading, pulverization and classification; a process, in which the shape of particles obtained by the kneading and pulverization process is changed by a mechanical impact force and heat energy, an emulsion polymerization and aggregation process, in which a polymerizable monomer of a binder resin is subjected to emulsion polymerization to form a dispersion, and the dispersion and dispersions of a colorant with, depending on necessity, a releasing agent and a charge controlling agent are mixed, aggregated and fused by heat to obtain toner particles; and a suspension polymerization process, in which a solution containing a polymerizable monomer for obtaining a binder resin and a colorant with, depending on necessity a releasing agent and a charge controlling agent is suspended in an aqueous solvent and is polymerized. Furthermore a production process for forming a core-shell may also be conducted, in which the toner particles obtained by the foregoing processes are used as a core, on which aggregated particles are further adhered and fused by heat.

External Additive

In the apparatus for forming an image and the process for forming an image according to the invention, it is preferred that particles having an average particle diameter of about from 50 to 500 nm are contained in the toner as at least one kind of the external additives described in the foregoing from the standpoint of further improvement in cleaning property. The external additive having an average particle diameter of from 50 to 500 nm contained in the toner is accumulated at the minute deformed part at the tip of the cleaning blade, and thus invasion of the spherical toner to the deformed part at the tip edge of the cleaning blade is effectively suppressed, whereby rolling of the spherical toner can be suppressed (seal effect) to improve the cleaning property.

In order to conveniently supply the particles having an average particle diameter of from 50 to 500 nm to the tip part of the cleaning blade, it is most effective that the particles are added and adhered to the toner as an external additive, and in order to stably supply the particles to the tip edge of the cleaning blade, it is effective that the particles are transported to the edge of the cleaning blade under such conditions that the particles are retained on the surface of the toner particles. The external additive retained on the surface of the toner particles is released from the surface of toner particles by the stress formed by friction with the cleaning blade and is supplied to the deformed part at the tip of the cleaning blade.

When the average particle diameter of the external additive added for improving the cleaning property is less than 50 nm, they are difficult to be accumulated at the deformed part at the tip of the cleaning blade to fail to form an effective seal. When it exceeds 500 mn, they are difficult to be adhered on the surface of the toner particles and easily remove from the surface by the stirring power occurred in the developing device, and fail to be effectively supplied to the cleaning blade, and the seal effect and the stabilization effect of behavior of the cleaning effect cannot be exhibited for a long period of time. The average particle diameter of the external additive added for improving the cleaning property is more preferably from 80 to 300 nm.

The average particle diameter of the external additive added for improving the cleaning property preferably has a specific gravity in the range of from 1.3 to 1.9. When the specific gravity is more than 1.9, release of the external additive from the toner particles due to the stress inside the developing device are liable to be accelerated, and there are cases where the external additive cannot be effectively supplied to the cleaning blade. When the specific gravity is less than 1.3, on the other hand, aggregation and dispersion of the external additive is liable to occur, and standing of the external additive becomes ununiform to selectively concentrate the stress to a protruded part, whereby release of the external additive from the toner particles is accelerated, and there are cases where the external additive cannot be effectively supplied to the cleaning blade to fail to stably exhibit the seal effect for a long period of time.

The external additive added from improvement of the cleaning property preferably has a spherical shape. Owing to the spherical shape of the external additive, it can be uniformly dispersed on the surface of the toner particles to effectively suppress the release of the external additive. With respect to the definition of the spherical shape herein, the Wadell's sphericity $\Psi$ can be referred, and the sphericity is preferably 0.6 or more, and more preferably 0.8 or more.

The content of the external additive added for improving the cleaning property is preferably from 0.5 to 5 parts by weight per 100 parts by weight of the toner particles, and more preferably from 1 to 3 parts by weight. When the content is less than 0.5 part by weight, the cleaning property of the spherical toner is liable to be lowered, and there are cases where cleaning failure occurs, and when the content exceeds 5 parts by weight, filming and comet on the photoreceptor are liable to occur, both cases of which are not preferred.

It is considered that the effect of the spherical shape of the external additive is exhibited to a higher extent when the external additive has a distribution closer to the monodisperse state. With respect to the definition of the monodisperse state herein, the standard deviation of the average particle diameter including the aggregated bodies can be referred, and the standard deviation is preferably $D_{50}\times 0.22$ or less.

The material of the external additive added for improving the cleaning property is not particularly limited as far as it has the foregoing shape, and it is considered that silica is particularly preferred. One of the reasons thereof is that since silica has a refractive index around 1.5, influences do not occur on decrease in the transparency due to light scattering, particularly in the PE value (index of light transmittance) of formation of an image on an OHP sheet even when the particle diameter of silica is increased.

Ordinary fumed silica has a specific gravity of 2.2 and the maximum particle diameter of 50 nm limited by the production process. While the particle diameter can be increased by forming aggregated bodies, the monodisperse state is difficult to be obtained, and the seal effect cannot be stably obtained. Other representative examples of the inorganic fine particles include titanium oxide (specific gravity: 4.2, refractive index: 2.6), alumina (specific gravity: 4.0, refractive index: 1.8) and zinc oxide (specific gravity: 5.6, refractive index: 2.0). However, they have a large specific gravity, and when the particle diameter thereof is increased beyond 50 nm to effectively exhibit the seal effect at the deformed part at the tip edge of the cleaning blade, there are cases where the external additive is liable to be released from the toner particles when the particle diameter is 50 nm or more. These inorganic particles are not suitable to form a color image because of the high reactive indexes thereof.

Silica, particularly spherical monodisperse silica having a gravity of from 1.3 to 1.9, that is suitable as the material for the external additive added for improving the cleaning property can be obtained by a sol-gel process, which is one of wet processes. In the process, silica can be produced by a wet process without baking, and thus the specific gravity of silica can be controlled to low in comparison to the vapor phase oxidation process. The specific gravity thereof can further be adjusted by controlling the species and the treating amount of a hydrophobic treating agent in a hydrophobic treatment. The particle diameter of silica can be freely controlled by hydrolysis of the sol-gel process, the weight ratio of alkoxysilane, ammonia, alcohol and water in the condensation polymerization step, the reaction temperature, the agitation rate and the supplying rate. Monodisperse silica having a spherical shape can be obtained by producing the same by the sol-gel process.

A specific production process of silica can be conducted as follows. A silane compound, such as tetramethoxysilane, is added dropwise and stirred under the presence of water and an alcohol using aqueous ammonia as a catalyst with application of temperature. A silica sol suspension thus obtained by the reaction is subjected to centrifugal separation to separate wet silica gel from alcohol and aqueous ammonia. A solvent is added to the wet silica gel to again form silica sol, to which a hydrophobic treating agent is added to make the surface of the silica hydrophobic. As the hydrophobic treating agent, an ordinary silane compound can be used. The solvent is removed from the silica sol having been subjected to the hydrophobic treatment, which is then dried and sieved to obtain the aimed monodisperse silica. The thus obtained silica may be again subjected to the treatment of the sol-gel process.

As the silane compound, water soluble ones can be used. A compound represented by the chemical structural formula $R_aSiX_{4-R}$ (wherein a represents an integer of from 0 to 3; R represents an organic group, such as a hydrogen atom, an alkyl group and an alkenyl group; and X represents a hydrolyzable group, such as a chlorine atom, a methoxy group and an ethoxy group) can be used as the silane compound. All the kinds of chlorosilane, alkoxysilane, silazane and a special silylation agent can be used. Representative examples thereof include methyltrichlorosilane, dimethylidichlorosilane, trimethylchlorosilane, phenyltrichlorosilane, diphenyldichlorosilane, tetramethoxysilane, methyltrimethoxysilane, dimethyldimethoxysilane, phenyltrimethoxysilane, diphenyldiethoxysilane, tetramethoxysilane, methyltrimethoxysilane, dimethyldimethoxysilane, phenyltrimethoxysilane, diphenyldiethoxysilane, isobutyltrimethoxysilane, decyltrimethoxysilane, hexamethyldisilazane, N,O-(bistrimethylsilyl)acetamide, N,N-bis(trimethyl)aurea, tert-butyldimethylchlorosilane, vinyltrichlorosilane, vinyltimethoxysilane, vinyltriethoxysilane, γ-methacryloxypropyltrimehoxysilane, β-(3,4-epoxycyclohexyl)ethyltrimethoxysilane, γ-glycidoxypropyltriethoxysilane, γ-glycidoxypropylmethyldiethoxysilane, γ-mercaptopropyltrimethoxysilane and γ-chloropropyltrimethoxysilane.

Particularly preferred examples of the hydrophobic treating agent include dimethyldimethoxysilane, hexamethyldisilazane, methyltrimethoxysilane, isobutyltrimethoxysilane and decyltrimethoxysilane.

The external additive added for improving the cleaning property is supplied to die cleaning blade in the conditions where it is retained on the surface of the toner particles, but there are cases where a part is formed where the supplied amount of the external additive becomes extremely short depending on the image pattern on the surface of the latent image holding member. In order to prevent such a phenomenon, it is preferred that a toner image that is not transferred to the transfer material is formed on the surface of the latent image holding member with an arbitrary or prescribed timing (interval) in the non-image formation cycle. When the toner image that is not transferred is formed on the surface of the latent image holding member, the external additive added for improving the cleaning property is supplied to the cleaning blade to stabilize the behavior of the tip of the cleaning blade, and thus the cleaning performance can be stably maintained irrespective to the image pattern.

The term "non-image forming cycle" herein means such a cycle that a toner image formed on the surface of the latent image holding member is transported as it is to the cleaning unit (cleaning step) without supplying a transfer material. The toner image formed herein may be such a pattern that the external additive can be supplied in the longitudinal direction of the cleaning blade, and any of a solid image, a half-tone image and a line image can be used. The timing of formation of the toner image that is not transferred may be determined by a prescribed number of sheets, a prescribed cycles or a prescribed period of time, and may be an arbitrary timing.

In the apparatus for forming an image and the process for forming an image according to the invention, an inorganic compound for controlling the flowability and the charging property of the toner may be added as an external additive to the toner. It is necessary to sufficiently cover the surface of the toner particles with the external additive in order to control the flowability and the charging property of the toner, but the sufficient coverage cannot be obtained only by the external additive including the spherical monodisperse silica added for improving the cleaning property. Therefore, it is preferred that an inorganic compound having a small diameter is used in combination with the external additive for improving the cleaning property.

As the inorganic compound having a small diameter added to the toner, known ones can be used, and examples thereof include silica, alumina, titanium oxide, barium titanate, magnesium titanate, calcium titanate, strontium titanate, zinc oxide, silica sand, clay, mica, sand-lime, diatom earth, cerium chloride, red iron oxide, chromium oxide, cerium oxide, antimony trioxide, magnesium oxide, zirconium oxide, silicon carbide, silicon nitride, calcium carbonate, magnesium carbonate and calcium phosphate. The surface of the inorganic fine particles may be subjected to a known surface treatment depending on the objective use.

The inorganic compound having a small diameter added to the toner preferably has an average particle diameter of less than 50 nm, and more preferably from 5 to 30 nm. The addition amount thereof is preferably from 0.3 to 3.0 parts by weight per 100 parts by weight of the toner particles.

(2) Carrier

The toner may be used as a one-component developer constituted only by itself, but in general, it is used as a two-component developer by mixing with a carrier.

Examples of the carrier include those using, as a core material, a magnetic metal, such as iron, nickel and cobalt, a magnetic oxide, such as ferrite and magnetite, and glass beads, and it is preferably a magnetic material in order to adjust the volume resistivity by using the magnetic brush method. The core material generally has an average particle diameter in the range of from 10 to 500 μm, and preferably from 30 to 100 μm.

The carrier preferably has a resin coating layer formed by covering with a resin to impart charging property. Examples of the resin include polyethylene, polypropylene, polystyrene, polyacrylonitrile, polyvinyl acetate, polyvinyl alcohol, polyvinyl butyral, polyvinyl chloride, polyvinyl carbazole, polyvinyl ether, polyvinyl ketone, a vinyl chloride-vinyl acetate copolymer, a styrene-acrylic acid copolymer, a straight silicone resin formed with an organosiloxane bond and a modified product thereof, a fluorine resin, polyester, polyurethane, polycarbonate, a phenol resin, an amino resin, a melamine resin, a benzoguanamine resin, a urea resin, an amide resin and an epoxy resin, but it is not limited to these examples.

Examples of the method for forming the resin coating layer on the surface of the core material of the carrier include a dipping method, in which the core material is dipped in a coating layer forming composition, a spraying method, in which a coating layer forming composition is sprayed on the surface of the core material, a fluidized bed method, in which the coating layer forming composition is sprayed on the core material suspended by fluidizing air, and a kneader coater method, in which the core material and the coating layer forming composition are mixed in a kneader-coater, followed by removing a solvent.

The mixing ratio (weight ratio) of the toner and the carrier, toner/carrier, in the invention is preferably in the range of about from 1/100 to 30/100, and more preferably in the range about from 3/100 to 20/100.

The invention will be further described in more detail with reference to the following examples, but the invention is not construed as being limited thereto. All the "parts" referred in the composition of the toner and the carrier mean "parts weight" unless otherwise noted.

Measurement Method of Properties

The measurements of the properties of the composition of the toner and the rebound resilience of the cleaning blade are conducted in the following manner.

Measurement of Specific Gravity of External Additive

The specific gravity is measured according to JIS K0061, 5-2-1, using a Le Chatelier pycnometer. The specific operation is as follows.

(1) About 250 ml of ethyl alcohol is put in a Le Chatelier pycnometer and adjusted that the meniscus aligns the scale.

(2) The pycnometer is immersed in a constant temperature water bath, and the position of the meniscus is accurately read by the scale of the pycnometer at the time when the liquid temperature becomes 20.0±0.2° C. (The read accuracy is 0.025 ml.)

(3) About 100 g of the sample is weighed, and the mass thereof is designated as W.

(4) The weighed sample is put in the pycnometer and defoamed.

(5) The pycnometer is immersed in the constant temperature water bath, and the position of the meniscus is accurately read by the scale of the pycnometer at the time when the liquid temperature becomes 20.0±0.2° C. (The read accuracy is 0.025 ml.)

(6) The specific gravity is calculated by the following equations.

$$D=W/(L_2-L_1) \quad \text{(A)}$$

$$S=D/0.9982 \quad \text{(B)}$$

In the equations (A) and (B), D represents the density of the sample at 20° C. g/cm$^3$), S represents the specific gravity at 20° C. of the sample, W represents an apparent mass, (g) of the sample, $L_1$ represents the reading of the meniscus before putting the sample in the pycnometer at 20° C. (ml), $L_2$ represents the reading of the meniscus after putting the sample in the pycnometer at 20° C. (ml), and the value of 0.9982 is the density of water at 20° C. (g/cm$^3$).

Measurement of Primary Particle Diameter and Standard Deviation of External Additive The primary particle diameter and the standard deviation thereof are measured by using laser diffraction and scattering particle size distribution measuring apparatus (LA-910, produced by Horiba, Ltd.).

Measurement of Sphericity of External Additive

The Wadell's sphericity is used as the sphericity of the external additive, which is calculated according to the following equation (2).

$$\text{Sphericity } \Psi=S'/S \quad (2)$$

In the equation (2), S' represents the surface area of spheres having the same volume as the actual particles, which is obtained by calculation using the average particle diameter, and S represents the surface area of the actual particles, which is substituted by the BET specific surface area measured by using a powder specific surface area measuring apparatus, SS-100, produced by Shimadzu Corp.

Measurement of Average Shape Factor SF of Toner Particles

The average shape factor SF of the toner particles is measure in the following manner. The toner is sampled and introduced into an image analyzer (Luzex III, produce by Nireco Corp.), and analysis is conducted for 100 toner particles. The circle equivalent diameter is measure for the respective particles, and the shape factor SF of the respective toner particles is obtained from the length and the projected area according to the equation (1), followed by obtaining an arithmetic average thereof.

Measurement of Rebound Resilience of Cleaning Blade

The rebound resilience of the cleaning blade is measured according to the physical test method for vulcanized rubber, JIS K6301, and the measurement is made at an ordinary temperature (23° C.) after allowing the cleaning blade to stand in an atmosphere of an ordinary temperature (23° C.) for 2 hours.

Preparation of External Additive Added for Improving Cleaning Property (A) Preparation of Spherical Monodisperse Silica A Silica sol obtained by the sol-gel process is subjected to an HMDS (hexamethyldisilazane) treatment, followed by drying and pulverization, to obtain spherical monodisperse silica A having a specific gravity of 150, a sphericity Ψ of 0.85 and an average particle diameter $D_{50}$ of 135 nm (standard deviation: 29 nm<$D_{50}$×0.22=29.7 nm).

(B) Preparation of Spherical Monodisperse Silica B

Silica sol obtained by the sol-gel process is subjected to an HMDS treatment, followed by drying and pulverization, to obtain spherical monodisperse silica B having a specific gravity of 1.60, a sphericity Ψ of 0.90 and an average particle diameter $D_{50}$ of 80 nm (standard deviation: 13 nm<$D_{50}$×0.22=17.6 nm).

(C) Preparation of Spherical Monodisperse Silica C

Silica sol obtained by tie sol-gel process is subjected to an isobutyltrimethoxysilane treatment, followed by drying and pulverization, to obtain spherical monodisperse silica C having a specific gravity of 1.30, a sphericity Ψ of 0.70 and an average particle diameter $D_{50}$ of 100 nm (standard deviation: 20 nm<$D_{50}$×0.22=22 nm)

(D) Preparation of Spherical Monodisperse Silica D

Silica sol obtained by the sol-gel process is subjected to a decyltrimethoxysilane treatment, followed by drying and pulverization, to obtain spherical monodisperse silica D having a specific gravity of 1.90, a sphericity Ψ of 0.60 and an average particle diameter $D_{50}$ of 200 nm (standard deviation: 40 nm<$D_{50}$×0.22=44 nm).

Preparation of Toner Particles (a) Preparation of Resin Dispersion

Preparation of Resin Dispersion (1)

| | |
|---|---|
| Styrene | 370 g |
| n-Butyl acrylate | 30 g |
| Acrylic acid | 8 g |
| Dodecanethiol | 24 g |
| Carbon tetrabromide | 4 g |

The foregoing components are mixed and dissolved, and the resulting solution is dispersed as an emulsion in a solution obtained by dissolving 6 g of a nonionic surfactant Nonipol 400, produced by Sanyo Chemical Industries, Ltd.) and 10 g of an anionic surfactant (Neogen SC, produced by Dai-ichi Kogyo Seiyaku Co., Ltd.) in 550 g of ion exchanged water in a flask. The resulting dispersion is slowly mixed over 10 minutes, to which 50 g of ion exchanged water having 4 g of ammonium persulfate dissolved therein is added. After substituted with nitrogen, the content of the flask is heated until 70° C. over an oil bath under stirring, the emulsion polymerization is continued for 5 hours. As a result, a resin dispersion (1) having an average particle diameter of 155 nm dispersed therein, a glass transition point Tg of 59° C. and a weight average molecular weight Mw of 12,000 is obtained.

Preparation of Resin Dispersion (2)

| | |
|---|---|
| Styrene | 280 g |
| n-Butyl acrylate | 120 g |
| Acrylic acid | 8 g |

The foregoing components are mixed and dissolved, and the resulting solution is dispersed as an emulsion in a solution obtained by dissolving 6 g of a nonionic surfactant (Nonipol 400, produced by Sanyo Chemical Industries, Ltd.) and 12 g of an anionic surfactant (Neogen SC, produced by Dai-ichi Kogyo Seiyaku Co., Ltd.) in 550 g of ion exchanged water in a flask. The resulting dispersion is slowly mixed over 10 minutes, to which 50 g of ion exchanged water having 3 g of ammonium persulfate dissolved therein is added. After substituted with nitrogen, the content of the flask is heated until 70° C. over an oil bath under stirring, the emulsion polymerization is continued for 5 hours. As a result, a resin dispersion (2) having an average particle diameter of 105 mm dispersed therein, a glass transition point Tg of 53° C. and a weight average molecular weight Mw of 550,000 is obtained.

(b) Preparation of Colorant Dispersion

Preparation of Colorant Dispersion (1)

| | |
|---|---|
| Carbon black<br>(Mogul L, produced by Cabot Corp.) | 50 g |
| Nonionic surfactant<br>(Nonipol 400, produced by Sanyo Chemical Industries, Ltd.) | 5 g |
| Ion exchanged water | 200 g |

The foregoing components are mixed and dissolved, and the resulting solution is dispersed for 10 minutes by using a homogenizer (Ultra-Turrax T50, produced by IKA Corp.) to prepare a colorant dispersion (1) having particles of a colorant (carbon black) having an average particle diameter of 250 nm dispersed therein.

Preparation of Colorant Dispersion (2)

| | |
|---|---|
| Cyan pigment<br>(C.I. Acid Blue 15:3) | 70 g |
| Nonionic surfactant<br>(Nonipol 400, produced by Sanyo Chemical Industries, Ltd.) | 5 g |
| Ion exchanged water | 200 g |

The foregoing components are mixed and dissolved, and the resulting solution is dispersed for 10 minutes by using a homogenizer (Ultra-Turrax T50, produced by IKA Corp.) to prepare a colorant dispersion (2) having particles of a colorant (cyan pigment) having an average particle diameter of 250 nm dispersed therein.

Preparation of Colorant Dispersion (3)

| | |
|---|---|
| Magenta pigment<br>(C.I. Acid Red 122) | 70 g |
| Nonionic surfactant<br>(Nonipol 400, produced by Sanyo Chemical Industries, Ltd.) | 5 g |
| Ion exchanged water | 200 g |

The foregoing components are mixed and dissolved, and the resulting solution is dispersed for 10 minutes by using a homogenizer (Ultra-Turrax T50, produced by IKA Corp.) to prepare a colorant dispersion (3) having particles of a colorant (magenta pigment) having an average particle diameter of 250 nm dispersed therein.

Preparation of Colorant Dispersion (4)

| | |
|---|---|
| Yellow pigment<br>(C.I. Acid Yellow 180) | 100 g |
| Nonionic surfactant<br>(Nonipol 400, produced by Sanyo Chemical Industries, Ltd.) | 5 g |
| Ion exchanged water | 200 g |

The foregoing components are mixed and dissolved, and the resulting solution is dispersed for 10 minutes by using a homogenizer (Ultra-Turrax T50, produced by IKA Corp.) to prepare a colorant dispersion (4) having particles of a colorant (yellow pigment) having an average particle diameter of 250 nm dispersed therein.

(c) Preparation of Releasing Agent Dispersion

| | |
|---|---|
| Paraffin wax<br>(HNP0190, melting point: 85° C., produced by Nippon Seiro Co., Ltd.) | 50 g |
| Cationic surfactant<br>(Sanisol B50, produced by Kao Corp.) | 5 g |

The foregoing components are dispersed in a round stainless steel flask by using a homogenizer (Ultra-Turrax T50, produced by IKA Corp.) for 10 minutes, and then subjected to a dispersion treatment by using a pressure discharging type homogenizer, so as to obtain a releasing agent dispersion (1) having releasing agent particles of an average particle diameter of 550 nm dispersed therein.

(d) Preparation of Toner

| | |
|---|---|
| Resin dispersion (1) | 120 g |
| Resin dispersion (2) | 80 g |
| One of colorant dispersions (1) to (4) | 200 g |
| Releasing agent dispersion (1) | 40 g |
| Cationic surfactant (Sanizol B50, produced by Kao Corp.) | 1.5 g |

The foregoing components are mixed and dispersed in a round stainless steel flask by using a homogenizer (Ultra-Turrax T50, produced by IKA Corp.), and heated to 50° C. over a heating oil bath with stirring the content of the flask. After maintaining at 45° C. for 20 minutes, observation is made by using an optical microscope, and it is found that aggregated particles having an average particle diameter of about 4.0 μm are formed. 60 g of the resin dispersion (1) as a resin-containing fine particle dispersion is gradually added to the resulting dispersion. The temperature of the heating oil bath is increased to 50° C. and maintained for 30 minutes. Observation with an optical microscope reveals that resin-attached particles having an average particle diameter of about 4.8 μm are formed.

After adding 3 g of anionic surf (Neogen SC, produced by Dai-ichi Kogyo Seiyaku Co., Ltd.) to the dispersion containing the resin-attached particles, the stainless steel flask is sealed and heated to 105° C. by using a magnetic seal with stirring the content of the flask, followed by maintaining for 4 hours.

After cooling, the reaction product is filtered and sufficiently washed with ion exchanged water, followed by drying, to obtain toner particles of the respective colors. The details of the toner particles thus obtained are as follows.

Black Toner Particles

The black toner particles obtained by using the colorant dispersion (1) according to the foregoing process have an average shape factor SF of 118.5 and a volume average particle diameter $D_{50}$ of 5.2 μm.

Cyan Toner Particles

The cyan toner particles obtained by using the colorant dispersion (2) according to the foregoing process have an average shape factor SF of 119 and a volume average particle diameter $D_{50}$ of 5.4 μm.

Magenta Toner Particles

The magenta toner particles obtained by using the colorant dispersion (3) according to the foregoing process have an average shape factor SF of 120.5 and a volume average particle diameter $D_{50}$ of 5.5 μm.

Yellow Toner Particles

The yellow toner particles obtained by using the colorant dispersion (4) according to the foregoing process have an average shape factor SF of 120 and a volume average particle diameter $D_{50}$ of 5.3 μm.

Production of Carrier

| | |
|---|---|
| Ferrite particles (volume average particle diameter: 50 μm) | 100 parts |
| Toluene | 14 parts |
| Styrene-methyl methacrylate copolymer (compositional ratio: 90/10) | 2 parts |
| Carbon black (R330, produced by Cabot Corp.) | 0.2 part |

A mixture of the foregoing components other than the ferrite particles is dispersed by using a stirrer for 10 minutes to prepare a coating composition. The resulting coating composition and the ferrite particles are placed in a vacuum deaeration type kneader, and after mixing at a temperature of 60° C. for 30 minutes, it is further heated under reduced pressure and deareated to dry, whereby a carrier is produced.

Production of Developer

Developer A 3 parts of the spherical monodisperse silica A are added to 100 parts each of the black toner particles, the cyan toner particles, the magenta toner particles and the yellow toner particles, and after blending by using a Henschel mixer at a peripheral speed of 32 m/s for 10 minutes, 1 part of an isobutyltrimethoxysilane compound of metatitanic acid (average particle diameter $d_{50}$:35 nm) is added thereto and blended at a peripheral speed of 20 m/s for 5 minutes, followed by removing coarse particles by using a sieve of 45 μm mesh, so as to obtain a toner. 100 parts of the carrier and 5 parts of the toner are stirred by using a V blender at 40 rpm for 20 minutes, and sieved by a mesh of 177 μm to obtain developers A of four colors.

Developer B 3 parts of the spherical monodisperse silica B are added to 100 parts each of the black toner particles, the cyan toner particles, the magenta toner particles and the yellow toner particles, and after blending by using a Henschel mixer at a peripheral speed of 32 m/s for 10 minutes, 1 part of an isobutylsilane compound of metatitanic acid (average particle diameter $d_{50}$:35 nm) is added thereto and blended at a peripheral speed of 20 m/s for 5 minutes, followed by removing coarse particles by using a sieve of 45 μm mesh, so as to obtain a toner. 100 parts of the carrier and 5 parts of the toner are stirred by using a V blender at 40 rpm for 20 minutes, and sieved by a mesh of 177 μm to obtain developers B of four colors.

Developer C 3 parts of the spherical monodisperse silica C are added to 100 parts each of the black toner particles, the cyan toner particles, the magenta toner particles and the yellow toner particles, and after blending by using a Henschel mixer at a peripheral speed of 32 m/s for 10 minutes, 1 part of an isobutylsilane compound of metatitanic acid (average particle diameter $d_{50}$:35 nm) is added thereto and blended at a peripheral speed of 20 m/s for 5 minutes, followed by removing coarse particles by using a sieve of 45 μm mesh, so as to obtain a toner. 100 parts of the carrier and 5 parts of the toner are stirred by using a V blender at 40 rpm for 20 minutes, and sieved by a mesh of 177 μm to obtain developers C of four colors.

Developer D 3 parts of the spherical monodisperse silica D are added to 100 parts each of the black toner particles, the cyan toner particles, the magenta toner particles and the yellow toner particles, and after blending by using a Henschel mixer at a peripheral speed of 32 m/s for 10 minutes, 1 part of an isobutylsilane compound of metatitanic acid (average particle diameter $d_{50}$:35 nm) is added thereto and blended at a peripheral speed of 20 m/s for 5 minutes, followed by removing coarse particles by using a sieve of 45 μm mesh, so as to obtain a toner. 100 part of the carrier and 5 parts of the toner are stirred by using a V blender at 40 rpm for 20 minutes, and sieved by a mesh of 177 μm to obtain developers D of four colors.

Cleaning Blade

In the examples, seven kinds of cleaning blades 1 to 7 having the properties shown in Table 1 below are used.

TABLE 1

(Properties of Cleaning Blades)

| Cleaning blade No. | Hardness(JIS-A) | rebound resilience (%) | 100% Modulus kgf/cm$^2$ | 100% Modulus kPa | 300% Modulus kgf/cm$^2$ | 300% Modulus kPa | Tensile strength kgf/cm$^2$ | Tensile strength kPa | Tearing strength kgf/cm | Tearing strength N/m |
|---|---|---|---|---|---|---|---|---|---|---|
| Cleaning blade 1 | 79 | 38 | 58 | 5,684 | 190 | 18,620 | 410 | 40,180 | 85 | 83,300 |
| Cleaning blade 2 | 77 | 35 | 53 | 5,194 | 160 | 15,680 | 400 | 39,200 | 83 | 81,340 |
| Cleaning blade 3 | 75 | 34 | 51 | 4,998 | 157 | 15,386 | 400 | 39,200 | 81 | 79,380 |
| Cleaning blade 4 | 70 | 39 | 28 | 2,744 | 120 | 11,760 | 290 | 28,420 | 38 | 37,240 |
| Cleaning blade 5 | 77 | 53 | 29 | 2,842 | 147 | 14,406 | 340 | 33,320 | 51 | 49,980 |
| Cleaning blade 6 | 70 | 37 | 36 | 3,528 | 133 | 13,034 | 270 | 26,460 | 44 | 43,120 |
| Cleaning blade 7 | 67 | 52 | 30 | 2,940 | 77 | 7,546 | 270 | 26,460 | 35 | 34,300 |

EXAMPLE 1

Evaluation of the cleaning property and the durability is conducted by using a modified machine as a photoreceptor unit of Docucolor 1250 produced by Fuji Xerox Co., Ltd., in which a charging device is changed from a scorotron to a contact type roll-formed charging device, and the cleaning blade generally equipped is replaced by the cleaning blade 1. The cleaning blade 1 has a thickness of 2.0 mm and a fee length of 9.0 mm. The deformation amount of the cleaning blade 1 that is made in contact with a photoreceptor (latent image holding member) is 1.1 mm, and the contact angle with the photoreceptor is 22°. The contact pressure of pressing the blade on the photoreceptor is $3.1\times10^{-2}$ N/mm (3.2 gf/mm). A suite of the developers of four colors of the developer A is installed in the developing device.

A running test of outputting 10,000 sheets of fill color images with 5% of image density for respective colors is conducted under a high temperature and high humidity (28°C., 85%RH) environment and a low temperature and low humidity (10° C., 15%RH) environment. Damages on the surface of the photoreceptor after outputting 10,000 sheets are sufficiently light, and cleaning failure, comet and filming under the low temperature and low humidity environment, and breakage of the edge of the cleaning blade and curling of the cleaning blade under the high temperature and high humidity environment do not occur, so as to obtain good cleaning property.

EXAMPLE 2

A running test is conducted in the same manner as in Example 1 except that the cleaning blade 1 is replaced by the cleaning blade 2. The contact pressure of pressing the blade on the photoreceptor is $2.8\times10^{-2}$ N/mm (2.9 gf/mm).

As a result of the running test, damages on the surface of the photoreceptor after outputting 10,000 sheets are sufficiently light, and cleaning failure, comet and filming under the low temperature and low humidity environment, and breakage of the edge of the cleaning blade and curling of the cleaning blade under the high temperature and high humidity environment do not occur, so as to obtain good cleaning property as similar to Example 1.

EXAMPLE 3

A running test is conducted in the same manner as in Example 1 except that the cleaning blade 1 is replaced by the cleaning blade 3, and the deformation amount of the cleaning blade 3 is changed to 1.2 mm. The contact pressure of pressing the blade on the photoreceptor is $2.9\times10^{-2}$ n/mm (3.0 gf/mm).

As a result of the running test, damages on the surface of the photoreceptor after outputting 10,000 sheets are sufficiently light, and cleaning failure, comet and filming under the low temperature and low humidity environment, and breakage of the edge of the cleaning blade and curling of the cleaning blade under the high temperature and high humidity environment do not occur, so as to obtain good cleaning property as similar to Example 1.

EXAMPLE 4

A running test is conducted in the same manner as in Example 1 except that the thickness of the cleaning blade 1 is changed to 1.1 mm, and the free length of the cleaning blade is changed to 10 mm. The contact pressure of pressing the blade on the photoreceptor is $1.7\times10^{-2}$ N/mm (1.7 gf/mm).

As a result of the running test, damages on the surface of the photoreceptor after outputting 10,000 sheets are sufficiently light, and cleaning failure, comet and filming under the low temperature and low humidity environment, and breakage of the edge of the cleaning blade and curling of the cleaning blade under the high temperature and high humidity environment do not occur, so as to obtain good cleaning property as similar to Example 1.

EXAMPLE 5

A running test is conducted in the same manner as in Example 1 except that the developer A is replace by the developer B.

As a result of the running test, damages on the surface of the photoreceptor after outputting 10,000 sheets are sufficiency light, and cleaning failure, comet and filming under the low temperature and low humidity environment, and breakage of the edge of the cleaning blade and curling of the cleaning blade under the high temperature and high humidity environment do not occur, so as to obtain good cleaning property as similar to Example 1.

EXAMPLE 6

A running test is conducted in the same manner as in Example 1 except that the developer A is replaced by the developer C.

As a result of the running test, damages on the surface of the photoreceptor after outputting 10,000 sheets are sufficiency light, and cleaning failure, comet and filming under the low temperature and low humidity environment, and breakage of the edge of the cleaning blade and curling of the cleaning blade under the high temperature and high humidity environment do not occur, so as to obtain good cleaning property as similar to Example 1.

EXAMPLE 7

A running test is conducted in the same manner as in Example 1 except that the developer A is replaced by the developer D.

As a result of the running test, damages on the surface of the photoreceptor after outputting 10,000 sheets are sufficiently light, and cleaning failure, comet and filming under the low temperature and low humidity environment, and breakage of the edge of the cleaning blade and curling of the cleaning blade under the high temperature and high humidity environment do not occur, so as to obtain good cleaning property as similar to Example 1.

COMPARATIVE EXAMPLE 1

A running test is conducted in the same manner as in Example 1 except that the cleaning blade 1 is replaced by the cleaning blade 4 having a thickness of 2.2 mm and a free length of 7.5 mm, and the deformation amount of the cleaning blade 4 is 1.0 mm. The contact pressure of pressing the blade on the photoreceptor is $3.2\times10^{-2}$ N/mm (3.3 gf/mm).

As a result of the running test, the cleaning property after outputting 10,000 sheets of full color images is good under the low temperature and low humidity environment, but under the high temperature and high humidity environment, toner cleaning failure in the form of stripes occurs on the photoreceptor after outputting several sheets from the start of output. Observation of the edge of the cleaning blade reveals that the edge is broken.

COMPARATIVE EXAMPLE 2

A running test is conducted in the same manner as in Comparative Example 1 except that the thickness of the cleaning blade 4 is changed to 2 mm, the free length thereof is changed to 10.0 mm, and the deformation amount is changed to 1.1 mm. The contact pressure of pressing the blade on the photoreceptor is $1.6\times10^{-2}$ N/mm (1.6 gf/mm).

As a result of the running test, after outputting 600 sheets of full color images under the low temperature and low humidity environment, cleaning failure of forming many stripes of the toner occurs on the photoreceptor, particularly in a region where the image density is high. Under the high temperature and high humidity environment, no problem occurs after outputting 10,000 sheets of full color images.

COMPARATIVE EXAMPLE 3

A running test is conducted in the same manner as in Example 1 except that the cleaning blade 1 is replaced by the cleaning blade 5 having a thickness of 2 mm and a free length of 8.0 mm, and the deformation amount of the cleaning blade 5 is 1.0 mm. The contact pressure of pressing the blade on the photoreceptor is $3.3\times10^{-2}$ N/mm (3.4 gf/mm).

As a result of the running test, the cleaning property after outputting 10,000 sheets of full color images is good under the low temperature and low humidity environment, but under the high temperature and high humidity environment, toner cleaning failure in the form of stripes occurs on the photoreceptor after outputting several sheets from the start of output. Observation of the edge of the cleaning blade reveals that the edge is broken.

COMPARATIVE EXAMPLE 4

A running test is conducted in the same manner as in Comparative Example 3 except that the free length of the cleaning blade 5 is changed to 10.0 mm. The contact pressure of pressing the blade on the photoreceptor is $1.7\times10^{-2}$ N/mm (1.74 gf/mm).

As a result of the running test, after outputting 600 sheets of full color images under the low temperature and low humidity environment, cleaning failure of forming many stripes of the toner occurs on the photoreceptor, particularly in a region where the image density is high. Under the high temperature and high humidity environment, no problem occurs after outputting 10,000 sheets of fill color images.

COMPARATIVE EXAMPLE 5

A running test is conducted in the same manner as in Example 1 except that the cleaning blade 1 is replaced by the cleaning blade 6 having a thickness of 2 mm and a free length of 75 mm, and the deformation amount of the cleaning blade 6 is 1.2 mm. The contact pressure of pressing the blade on the photoreceptor is $3.2\times10^{-2}$ N/mm (3.3 gf/mm).

As a result of the running test, the cleaning property after outputting 10,000 sheets of full color images is good under the low a time and low humidity environment, but under the high temperature and high humidity environment, toner cleaning failure in the form of stripes occurs on the photoreceptor after outputting several sheets from the start of output. Observation of the edge of the cleaning blade reveals that the edge is broken.

COMPARATIVE EXAMPLE 6

A running test is conducted in the same manner as in Comparative Example 5 except that the free length of the cleaning blade 6 is changed to 10.0 mm, and the deformation amount thereof is changed to 1.3 mm. The contact pressure of pressing the blade on the photoreceptor is $1.5\times10^{-2}$ N/mm (1.5 gf/mm).

As a result of the running test, after outputting 600 sheets of full color images under the low temperature and low humidity environment, cleaning failure of forming many stripes of the toner occurs on the photoreceptor, particularly in a region where the image density is high. Under the high temperature and high humidity environment, no problem occurs after outputting 10,000 sheets of full color images.

COMPARATIVE EXAMPLE 7

A running test is conducted in the same manner as in Example 1 except that the cleaning blade 1 is replaced by the cleaning blade 7 having a thickness of 2 mm and a free length of 7.5 mm, and the deformation amount of the cleaning blade 7 is 1.2 mm. The contact pressure of pressing the blade on the photoreceptor is $3.1\times10^{-2}$ N/mm (3.1 gf/mm).

As a result of the running test, the cleaning property after outputting 10,000 sheets of full color images is good under the low temperature and low humidity environment, but under the high temperature and high humidity environment, toner cleaning failure in the form of stripes occurs on the photoreceptor after outputting several sheets from the start of output. Observation of the edge of the cleaning blade reveals that the edge is broken.

COMPARATIVE EXAMPLE 8

A running test is conducted in the same manner as in Comparative Example 7 except that the free length of the cleaning blade 7 is changed to 9.0 mm, and the deformation amount thereof is changed to 1.1 mm. The contact pressure of pressing the blade on the photoreceptor is $1.6\times10^{-2}$ N/mm (1.66 gf/mm).

As a result of the running test, after outputting 600 sheets of full color images under the low temperature and low humidity environment, cleaning failure of forming many stripes of the toner occurs on the photoreceptor, particularly in a region where the image density is high. Under the high temperature and high humidity environment, no problem occurs after outputting 10,000 sheets of full color images.

As described in the foregoing, according to the invention, a cleaning blade for a latent image holding member, an apparatus for forming an image and a process for forming an image are provided at a low cost that ensure the good cleaning property of the latent image holding member irrespective to the temperature environment upon use without deterioration of image quality even in an apparatus for forming an image using a spherical toner.

The entire disclosure of Japanese Patent Application No. 2000-256052 filed on Aug. 25, 2000 including specification, claim, drawings and abstract is incorporated herein by reference in its entirety.

What is claimed is:

1. A cleaning blade for removing a remaining toner by contacting a latent image holding member under pressure, the blade comprising an elastic material having a 300% modulus of about from 14,700 to 29,400 kPa and a tearing strength of about 68,600 N/m or more.

2. The cleaning blade as claimed in claim 1, wherein the cleaning blade has a hardness (JIS A Scale) of about from 73 to 85.

3. The cleaning blade as claimed in claim 1, wherein the cleaning blade has a 100% modulus of about from 4,900 to 6,860 kPa.

4. The cleaning blade as claimed in claim 1, wherein the cleaning blade has a tensile strength of about 37,240 kPa or more.

5. The cleaning blade as claimed in claim 1, wherein the remaining toner includes toner particles having an average shape fair SF expressed by the following equation (1) of about from 100 to 135:

$$SF=100\times\pi ML^2/4A \quad (1)$$

wherein ML represents a maximum length of a toner particle, and A represents a projected area of a toner particle.

6. An apparatus for forming an image comprising a latent image holding member, a latent image forming unit for forming a latent image on a surface of the latent image holding member, a developing unit for developing the latent image formed on the surface of the latent image holding member with a toner to form a toner image, a transferring unit for transferring the toner image formed on the surface of the latent image holding member to a transfer material, and a cleaning unit for removing a remaining toner on the surface of the latent image holding member after the transfer, the cleaning unit comprising a cleaning blade rubbing the surface of the latent image holding member therewith, and the cleaning blade comprising an elastic material having a 300% modulus of about from 14,700 to 29,400 kPa and a tearing strength of about 68,600 N/m or more.

7. The apparatus for forming an image as claimed in claim 6, wherein the cleaning blade has a hardness (JIS A Scale) of about from 73 to 85.

8. The apparatus for forming an image as claimed in claim 6, wherein the cleaning blade has a 100% modulus of about from 4,900 to 6,860 kPa.

9. The apparatus for forming an image as claimed in claim 6, wherein the cleaning blade has a tensile strength of about 37,240 kPa or more.

10. The apparatus for forming an image as claimed in claim 6, wherein the toner includes toner particles having an average shape factor SF expressed by the following equation (1) of about from 100 to 135:

$$SF=100\times\pi ML^2/4A \quad (1)$$

wherein ML represents a maximum length of a toner particle, and A represents a projected area of a toner particle.

11. The apparatus for forming an image as claimed in claim 6, wherein the toner comprises toner particles and an external additive, and at least one kind of the external additive has an average particle diameter of about from 50 to 500 mm.

12. The apparatus for forming an image as claimed in claim 6, wherein a contact pressure of pressing the cleaning blade to the latent image holding member is about from $9.8\times10^{-3}$ to $4.9\times10^{-2}$ N/mm.

13. A process for forming an image comprising: forming a latent image on a surface of a latent image holding member; developing the latent image formed on the surface of the latent image holding member with a toner to form a toner image; transferring the toner image formed on the surface of the latent image holding member to a transfer material; and removing a remaining toner on the surface of the latent image holding member after transfer, the removing step containing a step of rubbing the surface of the latent image holding member with a cleaning blade, the cleaning blade having an elastic material having a 300% modulus of about from 14,700 to 29,400 kPa and a tearing strength of about 68,600 N/m or more.

14. The process for forming an image as claimed in claim 13, wherein the cleaning blade has a hardness (JIS A Scale) of about from 73 to 85.

15. The process for forming an image as claimed in claim 13, wherein the cleaning blade has a 100% modulus of about from 4,900 to 6,860 kPa.

16. The process for forming an image as claimed in claim 13, wherein the cleaning blade has a tensile strength of about 37,240 kPa or more.

17. A process for forming an image as claimed in claim 13, wherein the toner includes toner particles having an average shape factor SF expressed by the following equation (1) of about from 100 to 135:

$$SF=100\times\pi ML^2/4A \quad (1)$$

wherein ML represents an maximum length of a toner particle, and A represents a projected area of a toner particle.

18. The process for forming an image as claimed in claim 13, wherein the toner comprises toner particles and an external additive, and at least one kind of the external additive has an average particle diameter of about from 50 to 500 nm.

19. The process for forming an image as claimed in claim 13, wherein a contact pressure of pressing the cleaning blade to the latent image holding member is about from $9.8\times10^{-3}$ to $4.9\times10^{-2}$ N/mm.

* * * * *